US005757086A

United States Patent [19]

Nagashima

[11] Patent Number: 5,757,086

[45] Date of Patent: May 26, 1998

[54] REMOTE STARTER WITH ANTI-THEFT PROTECTION

[75] Inventor: Yoshikazu Nagashima, Shizuoka, Japan

[73] Assignee: Yazaki Corporation, Tokyo, Japan

[21] Appl. No.: 692,134

[22] Filed: Aug. 5, 1996

[30] Foreign Application Priority Data

Aug. 7, 1995 [JP] Japan ..... 7-200673

[51] Int. Cl.[6] ..... F02N 11/08

[52] U.S. Cl. ..... 307/10.6; 123/179.2; 180/272

[58] Field of Search ..... 307/9.1–10.6; 123/179.2–179.4, 198 DB, 198 DC; 180/287, 272, 273; 290/37 R, 38 C, 38 R; 340/425.5, 426, 825.3–825.32, 825.69, 825.72

[56] References Cited

U.S. PATENT DOCUMENTS

| | | | |
|---|---|---|---|
| 3,455,403 | 7/1969 | Hawthorne | 123/179.2 |
| 3,646,515 | 2/1972 | Vodehnal | 180/287 |
| 4,392,059 | 7/1983 | Nespor | 123/179.2 |
| 5,024,186 | 6/1991 | Long et al. | 307/10.6 |
| 5,612,578 | 3/1997 | Drew | 123/179.2 |

FOREIGN PATENT DOCUMENTS

| | | |
|---|---|---|
| 63-11460 | 1/1988 | Japan . |
| 64-57377 | 4/1989 | Japan . |

*Primary Examiner*—Richard T. Elms
*Attorney, Agent, or Firm*—Armstrong, Westerman, Hattori, McLeland & Naughton

[57] ABSTRACT

A remote starter starts a driving mechanism in a vehicle from the outside through a command signal from a transmitter. A remote start releaser releases a remote drive state of the driving mechanism and converts it to an ordinary driving state. The presence of an operation to mechanisms in the vehicle is detected. The driving mechanism is stopped when the driving mechanism is in the remote drive state and the presence of an operation to mechanisms is detected. The theft of a vacant vehicle is thereby prevented.

15 Claims, 11 Drawing Sheets

REMOTE STARTER WITH ANTI-THEFT PROTECTION

BACKGROUND OF THE INVENTION

1. Field of the Invention

The present invention relates to a driving mechanism controlling apparatus for vehicle such as automobile, to start an engine as a driving means of a vehicle through remote control, and more particularly to a mechanism for preventing a vacant vehicle, under remote control for starting engine, from being stolen.

2. Description of the Related Art

A conventional driving mechanism controlling apparatus is disclosed in Japanese Patent Application Laid-open No. Showa 63-11460.

This apparatus is provided with an ordinary door lock mechanism and an engine starting mechanism for a vehicle represented by an automobile through an ignition key. Besides, the apparatus is provided with a keyless entry mechanism and devices attached thereto to lock doors and start an engine through remote control from a transmitter.

This conventional device comprises an ignition key as a transmitter with an infrared ray generator or an electromagnetic ray generator, and an infrared sensor as an infrared receiver or an antenna as an electromagnetic wave receiver. The ignition key is carried by a driver and the infrared sensor and the antenna are mounted to a prescribed position, for example, on a door handle or a rear wind shield in a vehicle.

The operation of the ignition key by the driver causes the ignition key to transmit modulated infrared signals or electromagnetic signals (hereinafter referred to as "operation signals"). These operation signals are received by the infrared sensor or the antenna, and are inputted to a data processing section.

The data processing section encodes the inputted signals and recognizes control command that the code signals mean, and generates control signals based on the control command. For example, control signals for operations such as closing and opening doors, starting engine, and shifting seats are generated.

The control signals are transmitted to each controlling mechanism so as to execute designated control.

In the above-mentioned apparatus, when an engine starts through remote control, starting operation through the ignition key, that is, insertion and rotation of the ignition key in a key cylinder in a predetermined period of time from the start of the engine through remote control is recognized as a normal engine starting operation, which maintains the rotation of the engine. Unless the starting operation with the ignition key is carried out in the predetermined period of time, it is judged to be abnormal to stop engine.

However, the start of the engine through remote control is carried out to finish warming up of an engine in advance for smooth motion thereof, and to drive the vehicle immediately after a driver has a seat in the vehicle.

Therefore, the predetermined period of time at the above-mentioned remote control is set relatively long period of time, about several minutes, in accordance with the time required for warming-up of the engine. In case that the engine starts and is warmed up through remote control, nobody may be in the vehicle for the above-mentioned reasons.

As described above, at the start of the engine and its warming-up through the remote control, nobody is in the vehicle for several minutes in spite of the engine is driven.

Therefore, for a period of time from the start of the engine to driver's ride to the vehicle, some measure should be taken to prevent a vehicle with the apparatus for starting engine as the above-mentioned conventional apparatus from being stolen.

SUMMARY OF THE INVENTION

The present invention has been made in consideration of the above-mentioned problems, and an object thereof is to provide a driving mechanism controlling apparatus capable of preventing a vacant vehicle with a driven engine from being stolen.

A driving mechanism controlling apparatus for vehicle according to the present invention comprises: remote start means for starting a driving mechanism in a vehicle from outside through command signal from a transmitter; remote start releasing means for releasing remote drive state of the driving mechanism and for converting it to an ordinary driving state; operation information outputting means for detecting presence of operation to mechanisms in the vehicle and for outputting operation information; and driving mechanism stopping means for stopping the driving mechanism when the driving mechanism is in the remote drive state and the operation signal from the operation information outputting means is detected.

Another driving mechanism controlling apparatus for vehicle according to the present invention comprises: remote start means for starting a driving mechanism in a vehicle from outside through command signal from a transmitter; remote start releasing means for releasing remote drive state of the driving mechanism and for converting the state of the driving mechanism to an ordinary driving state; power transmitting mechanism for transmitting power from the driving mechanism to wheels; operation information outputting means for detecting presence of operation to mechanisms in the vehicle and for outputting operation information; and power transmission stopping means for stopping the power transmitting mechanism when the driving mechanism is in the remote drive state and the operation signal from the operation information outputting means is detected.

Further driving mechanism controlling apparatus for vehicle according to the present invention comprises: remote start means for starting a driving mechanism in a vehicle from outside through command signal from a transmitter; remote start releasing means for releasing remote drive state of the driving mechanism and for converting the state of the driving mechanism to an ordinary driving state; operation information outputting means for detecting presence of operation to mechanisms in the vehicle and for outputting operation information; power transmitting mechanism for transmitting power from the driving mechanism to wheels; power transmission stopping means for stopping the power transmitting mechanism when the driving mechanism is in the remote drive state and the operation signal from the operation information outputting means is detected; and control selection means for transmitting selection information regarding selection from the driving mechanism stopping means and the power transmission stopping means to the operation information outputting means.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Now, a preferred embodiment of a driving mechanism controlling apparatus for vehicle according to the present invention will be explained with reference to drawings. Firstly, the configuration of the embodiment will be described with reference to FIGS. 2 to 5.

Figure 1:
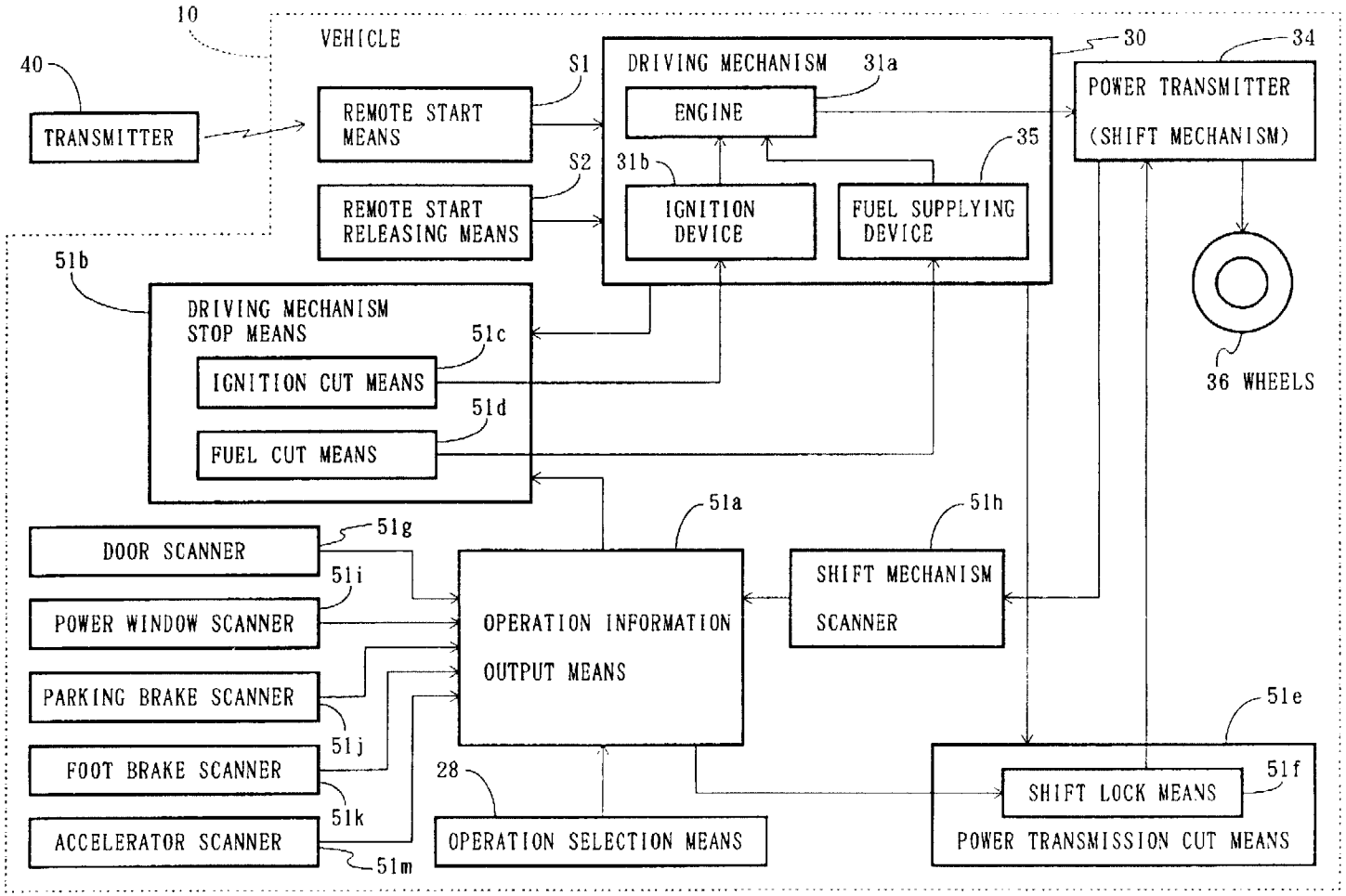
FIG. 1 is a drawing for explaining a basic configuration of a driving mechanism controlling apparatus according to the present invention.
Figure 2:
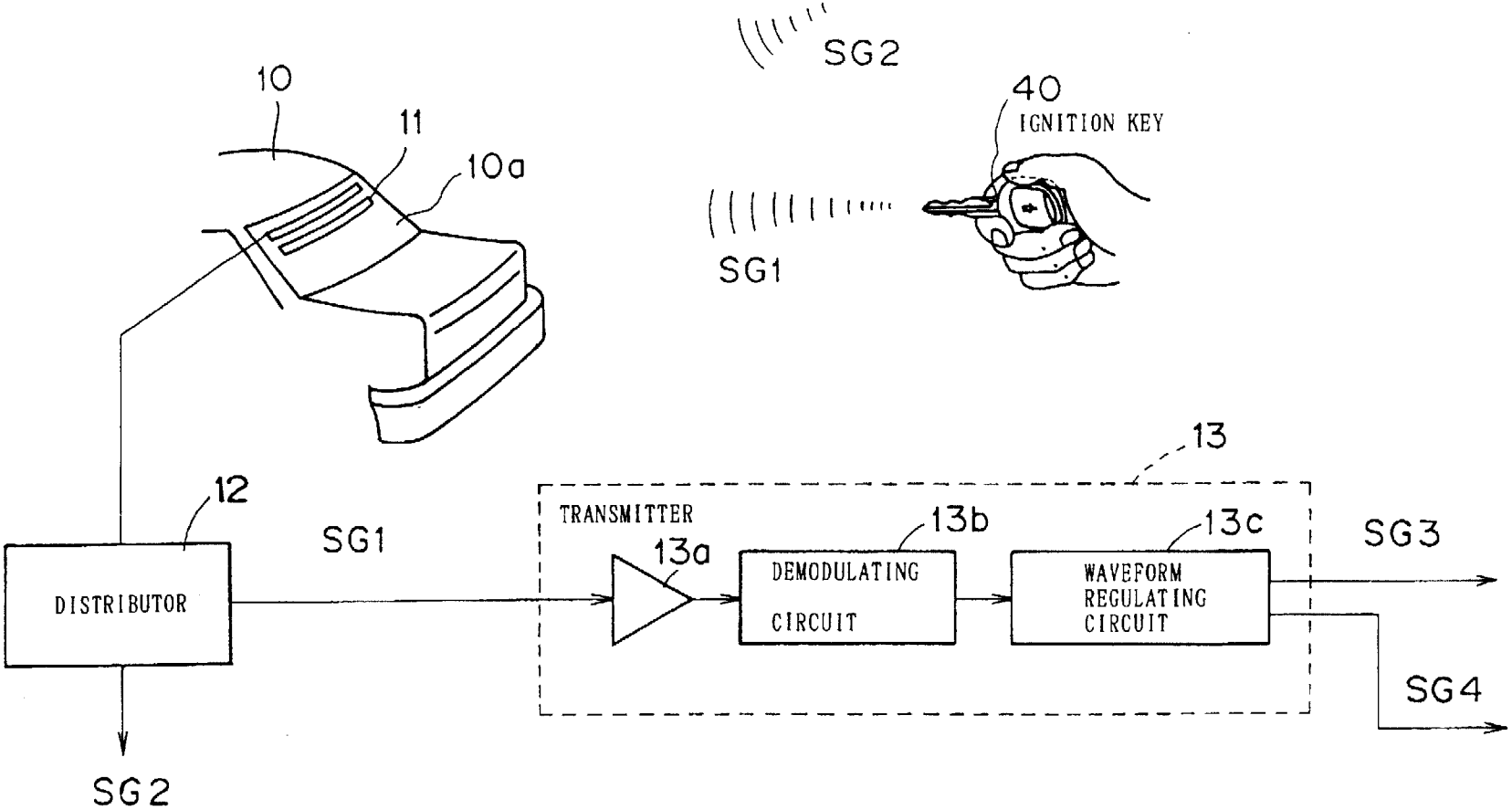
FIG. 2 is a block diagram showing transmitting and receiving mechanisms of a driving mechanism controlling apparatus according to an embodiment of the present invention.

FIG. 2 is a block diagram of remote starting means, and more particularly to a transmitter for transmitting control signals from outside of a vehicle and a receiver for receiving the control signals from the transmitter. In this figure, numeral 10 shows a main body, 11 an antenna, 12 a distributor, and 13 the receiver.

The main body 10 is that of a passenger car, and a rear shield 10*a* is positioned at the rear portion of the main body 10. On the surface of the rear shield 10*a* is positioned the linearly winding antenna 11. The antenna 11 receives electromagnetic waves in a prescribed frequency band such as electromagnetic wave SG1 containing operating information from an ignition key 40 as a transmitter, and electromagnetic wave SG2 containing oral information from radio set.

This ignition key 40 is provided with electromagnetic wave generating means not shown, and transmits the electromagnetic wave SG1 with high frequency corresponding to coded operating information at the operation by an operator. The electromagnetic wave generation means of the ignition key 40 is formed so as to output several pieces of operating information (code) in accordance with actual operation such as engine start and door unlock.

The distributor 12 is connected to an end of the antenna 11. The distributor 12 divides the electromagnetic wave (with high frequency) SG1 transmitted from the ignition key 40 and the electromagnetic wave SG2 with oral information (with low frequency) from each other, and the electromagnetic wave SG1 from the ignition key 40 which is distributed from the distributor 12 is transmitted to the receiver 13, and the electromagnetic wave SG2 with oral information is transmitted to a radio set not shown in the main body 10.

The receiver 13 is provided with an amplifier 13*a*, a demodulating circuit 13*b*, and a waveform regulating circuit 13*c*, and the electromagnetic signal with electromagnetic wave SG1, a high frequency signal, from the distributor 12 is firstly amplified by the amplifier 13*a*, and is transmitted to the demodulating circuit 13*b*.

In the demodulating circuit 13*b*, modulated signal component is extracted from the amplified signal. In other words, signal component corresponding to the operating information transmitted from the ignition key 40 is extracted. Further, the signal corresponding to the modulated signal component from the demodulating circuit 13*b* is regulated in the wave regulating circuit 13*c* so as to be converted to code signal SG3. The code signal SG3 is transmitted to a data processing section described below so as to be used for controlling an engine described below as a driving mechanism. Besides, the wave regulating circuit 13*c* outputs command signal for an ignition controller described below, that is, ignition control signal SG4 for switching a power source for mechanisms for the vehicle.

Therefore, the distributor 12 and the receiver 13 are normally in a state waiting for signals, and in this state, the distributor 12 and the receiver 13 are driven by a battery located in a line separated from a main power source of the vehicle (another battery described below).

Figure 3:
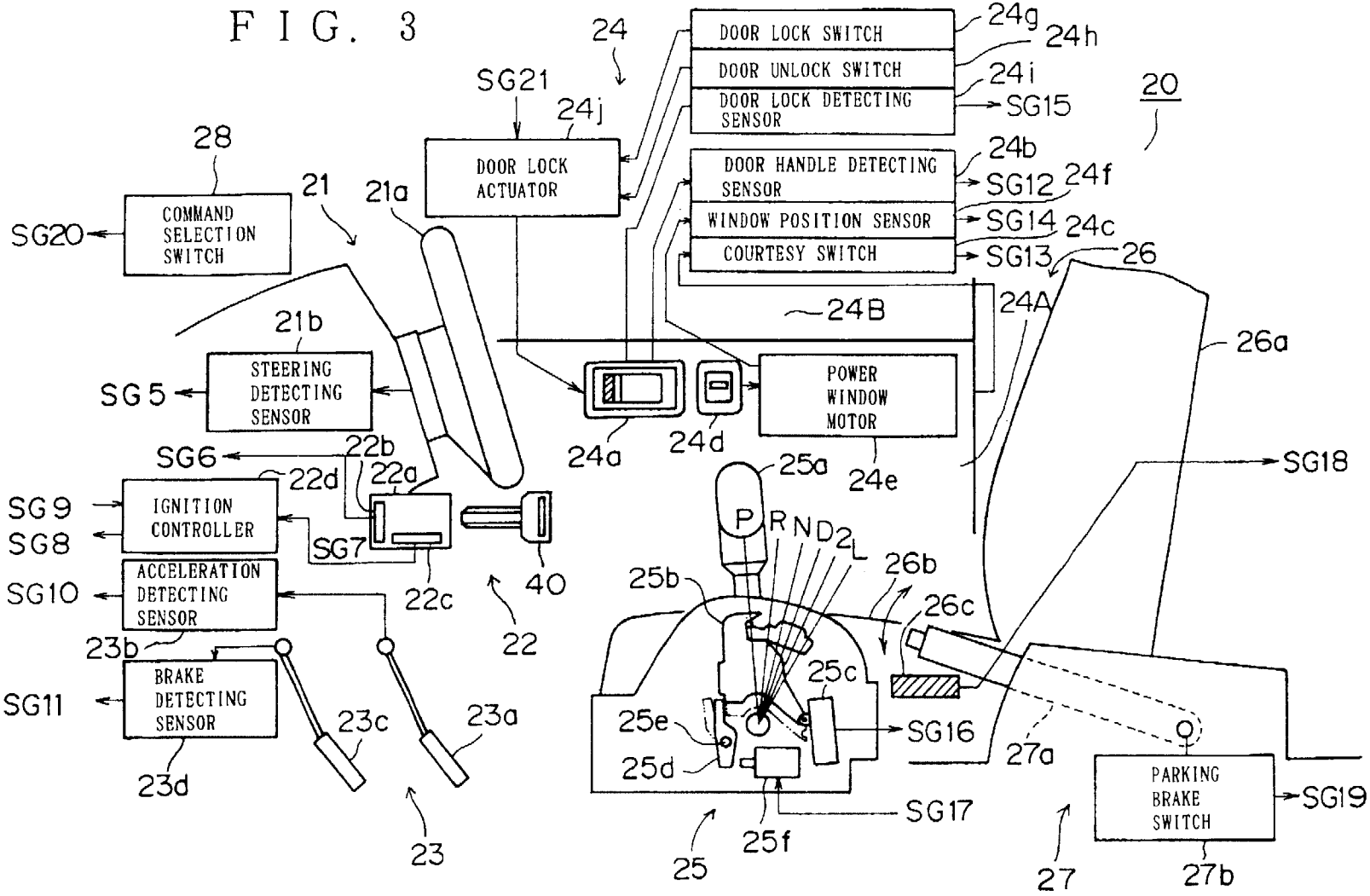
FIG. 3 is a block diagram showing the configuration in a vehicle according to the embodiment of the present invention.

Next, with reference to FIG. 3, mechanisms in the vehicle will be explained. FIG. 3 shows the construction in a vehicle (passenger vehicle), and numeral 20 shows inside of the vehicle, 21 a steering mechanism, 22 an ignition mechanism as an engine starter, 23 an acceleration/deceleration mechanism as an operation mechanism for speed control, 24 a door for a driver or passengers, 25 a shift operation mechanism for providing operating information from the driver to a shifting mechanism described below, 26 seats for the driver and passengers, 27 a parking brake mechanism for a parking brake which is used when the vehicle is parked for a long period of time, and 28 a command selection switch designating a motion of restricting treatment described below.

The steering mechanism 21 is an ordinary steering wheel 21*a* which is located at a preferable position for the driver seated. The steering wheel 21*a* is provided with a steering detecting sensor 21*b* for detecting the operation, that is, the rotation of the steering mechanism 21. The steering detecting sensor 21*b* outputs a steering operation signal SG5 at the operation of the steering wheel 21*a*.

The ignition mechanism 22 comprises a key cylinder 22*a*, a key switch 22*b*, a key positioning switch 22*c* and an ignition controller 22*d*.

The ignition key 40 is inserted into the key cylinder 22*a*, which is located, for instance, below the steering wheel 21*a*.

The key switch 22*b* detects the insertion of the ignition key 40 to the key cylinder 22*a*, and outputs a key detecting signal SG6 at the insertion of the ignition key 40.

The key positioning switch 22*c* outputs operating information from the ignition key 40 under the condition that the ignition key 40 is inserted to the key cylinder 22*a*. In accordance with the position of rotation angle of the ignition key 40, information such as engine start, ignition ON, ignition OFF and locking of steering wheel are outputted as key position information SG7.

The ignition controller 22*d* outputs a command signal for switching ON the power source of the vehicle or for starting the engine as an ignition information signal SG8 based on the key position information SG7. In addition, compulsory OFF information SG9 from the data processing section described below is inputted to the ignition controller 22*d*. When the compulsory OFF information SG9 is inputted to the ignition controller 22*d*, the controller 22*d* outputs ignition information as the ignition information signal SG8 for switching OFF the power source of the vehicle.

The acceleration/deceleration mechanism 23 comprises an acceleration pedal 23*a*, an acceleration detecting sensor 23*b*, a brake pedal 23*c* and a brake detecting sensor 23*d*. The acceleration pedal 23*a* and the brake pedal 23*c* are operated by a foot of the driver. The driver increases or decreases the rotation of the engine through the acceleration pedal 23*a*, and stops the vehicle through the brake pedal 23*c*. The acceleration detecting sensor 23*b* detects the operating condition of the acceleration pedal 23*a*, and outputs an acceleration detecting signal SG10 when the operation of the brake detecting sensor 23*d* exceeds a predetermined value. The brake detecting sensor 23*d* detects the operating condition of the brake pedal 23*c*, and outputs a brake detecting signal SG11 when the operation of the brake detecting sensor 23*d* exceeds a predetermined value.

The door 24 is provided with a door 24A, and a window 24B, which can be opened and closed, is attached to the door 24A.

The door 24 is further provided with a door handle 24*a*, a door handle detecting sensor 24*b*, a courtesy switch 24*c*, a power window operation switch 24*d*, a power window motor 24*e*, and a window position sensor 24*f*. The door handle 24*a* is operated to open the door 24A, and the door handle detecting sensor 24*b* detects the presence of the operation of the door handle 24*a*, that is, whether the operation for opening the door 24A is carried out or not is detected. The result is outputted as a door handle operation signal SG12 from the door handle detecting sensor 24*b*. Whether the door 24A is opened or closed is detected by the courtesy switch 24*c* and the result is outputted therefrom. The power window operation switch 24*d* is operated to open and close the window 24B. The power window motor 24*e* is driven to open and close the window 24B based on operation signals from the power window operation switch 24*d*. The window position sensor 24*f* attached to the window 24B outputs the condition, closing or opening, of the window 24B as a window position signal SG14.

The door 24 is further provided with a door lock switch 24*g*, a door unlock switch 24*h*, a door lock detecting sensor 24*i*, and a door lock actuator 24*k*. The door lock switch 24*g* is operated and outputs a lock signal when the door 24A is locked. The door unlock switch 24*h* is operated and outputs an unlock signal when the door 24A locked is unlocked. The door lock detecting sensor 24*i* detects whether the door 24A is locked or not, and outputs the result as a door lock detecting signal SG15. The door lock actuator 24*k* locks or unlocks the door 24A in accordance with the lock signal from the door lock switch 24*g*, the unlock signal from the door unlock switch 24*h*, or a door lock control signal SG21 from the data processing section described below.

The shift operation mechanism 25 comprises a selector bar 25*a*, a transmission plate 25*b*, a shift positioning switch 25*c*, a shift lock arm 25*d*, and a shift lock solenoid 25*f*.

The selector lever 25*a* is an operation mechanism for designating a shift position of a shifting mechanism described below such as P (parking), R (reverse), N (neutral), D (drive), 2 (second), and L (low).

In the aforesaid shift positions, the P position is selected to park a vehicle for a long period of time. At the P position, power transmitting mechanism located between the engine and the wheels cut off, so that the vehicle is immovable.

The transmission plate 25*b* is situated between the selector lever 25*a* and the shift positioning switch 25*c* to transmit the operation information on the shift position of the selector lever 25*a* to the shift positioning switch 25*c*. Then, the shift positioning switch 25*c* outputs operation information as a shift position information SG16 in accordance with the shift position of the selector lever 25*a*.

The shift lock arm 25*d* is a piece for fixing the movement of the transmission plate 25*b* through the engagement between them. In other words, the shift lock arm 25*d* is supported by a shaft 25*e* and rotates about it by the shift lock solenoid 25*f*. The shift lock solenoid 25*f* is controlled by a shift lock control signal SG17 from a data processing section described below.

When the shift lock arm 25*d* rotates and engages the transmission plate 25*b* as indicated by solid lines in the figure, the selector lever 25*a* is fixed to the P position. When the shift lock arm 25*d* and the transmission plate 25*b* are disengaged from each other, operation through the selector lever 25*a* is allowed.

The seat 26 comprises a rear face portion 26*a* and a seat face portion 26*b*. In the seat face portion 26*b* is positioned a seat sensor 26*c*. The seat sensor 26*c* is so-called pressure detecting sensor, which outputs voltage signal when a predetermined pressure is applied. The seat sensor 26*c* in this embodiment outputs seat detecting signal SG18 when a driver has a seat.

The parking brake mechanism 27 is provided with a parking brake lever 27*a*, and a parking brake switch 27*b*. When a driver operates the parking brake lever 27*a*, the parking brake switch 27*b* outputs a parking brake operation signal SG19.

The command selection switch 28 is a switch for designating the motion of the motion restricting processing as described above. This command selection switch 28 is operable by a driver and so on. In this embodiment, engine stop due to no ignition, and engine stop due to no fuel, and mere shift look is selected. And the condition selected is outputted as a selection signal SG20.

Figure 4:
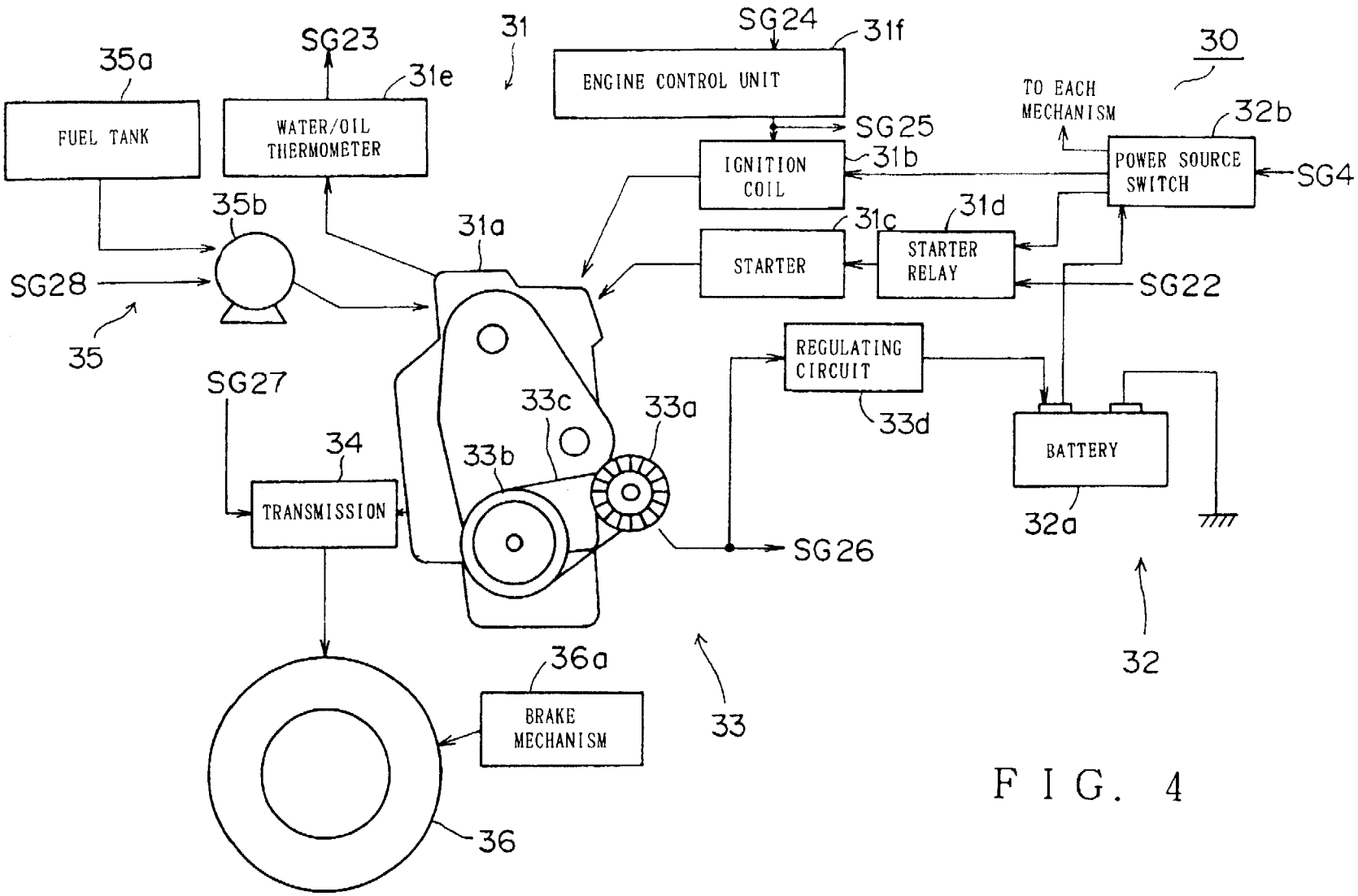
FIG. 4 is a block diagram showing the configuration of a driving mechanism in the vehicle according to the embodiment of the present invention.

Next, construction surrounding the engine as a driving mechanism for a vehicle will be described with reference to FIG. 4. FIG. 4 shows the construction 30 surrounding the engine. Numeral 31 is an engine unit and 32 a battery unit, 33 a power generating unit, 34 a transmission as a speed changer, 35 a fuel feeder, and 36 wheels.

The engine unit 31 is provided with an engine 31*a*, an ignition coil 31*b*, a starter 31*c*, a starter relay 31*d* and a water/oil thermometer 31*e*.

The engine 31*a* is a mechanism for obtaining power, that is, rotation through the combustion of fuel such as gasoline, and comprises a piston reciprocating in a cylinder, an ignition plug igniting a mixture of air and fuel in the cylinder which is compressed by the piston, a crank mechanism converting the reciprocating motion of the piston to rotational force, and a water-cooling mechanism maintaining the temperature of the engine itself in a prescribed range (all elements not shown). The engine 31*a* is controlled by an engine control unit 31*f* which is operated based on engine control signal SG24 from the data processing section described below.

A rotation detecting signal SG25 indicating the rotational condition of the engine 31*a* is obtained from a control signal transmitted from a primary terminal of the ignition coil 31b, that is, the engine control unit 31f to the ignition coil 31b.

The ignition coil 31b supplies high voltage to an ignition plug not shown of the engine 31a in synchronization with ignition timing signals which are generated in accordance with the position of the piston.

The starter 31c is a mechanism for rotating the crank mechanism of the engine 31a, and a starter signal SG22 from the data processing section described below is inputted to the starter relay 31d attached to the starter 31c to rotate the crank mechanism. Then, in accordance with the rotation of the crank mechanism the piston moves in the cylinder and ignition occurs by the ignition plug to start and drive the engine 31a.

The water/oil thermometer 31e detects the temperature of coolant (cooling water) as a cooling medium of the water-cooling mechanism, and engine oil as a lubricant for the engine 31a, and the results are inputted as water/oil temperature information SG23.

The battery unit 32 is provided with a battery 32a and a power source switch 32b. Electrical energy is accumulated in the battery 32a, and when the ignition control signal SG4 from the receiver 13 or the data processing section described below is inputted to the power source switch 32b connected to the battery 32a, the power source switch 32b is switched ON, and electrical energy, that is, power accumulated in the battery 32a is applied to the mechanisms in a vehicle.

The power generating unit 33 is provided with an alternator 33a, a pulley 33b, a belt 33c, and a rectifying circuit 33d.

The alternator 33a is a so-called alternating power generator, and generates alternating electrical signal through the rotation itself, which is transmitted to the rectifying circuit 33d.

The pulley 33b rotates in accordance with the rotation of the crank mechanism. The belt 33c is connected to both of the pulley 33b and the alternator 33a.

The rectifying circuit 33d is a circuit for converting alternating current signals to direct current signals, so that alternating current signals from the alternator 33a are converted to direct current signals of 12 V. Then, the direct current signals are supplied to the battery 32a to charge it.

Therefore, in the above-mentioned configuration, in a state that the engine 31a starts and is driven, the pulley 33b and the alternator 33a rotate to generate alternating current signals, which allows the battery 32a to be charged.

Voltage generated by the alternator 33a is obtained based on the alternating current signals generated by the alternator 33a. In other words, the alternating current signals generated by the alternator 33a are used as the voltage signals SG26.

The transmission 34 is a shifting mechanism for preferably reducing the rotational force generated by the engine 31a. The transmission 34 is located between the engine 31a and the wheels (driving wheels) 36. The transmission 34 is controlled through shift information SG27 from the data processing section described below. The rotational force of the engine 31a is transmitted to the wheels 36 at a reduction ratio indicated by the shift information SG27. The shift information SG27 is a control signal in accordance with the shift position information SG16 from the aforementioned shift operation mechanism 25.

In other words, the shift information SG27 is a signal for indicating the above-mentioned shift positions "P" to "L".

The wheels 36 is provided with a braking mechanism 36a, which is a restricting mechanism to restrict the rotation of the wheels 36 in accordance with the depression of the brake pedal 23c.

The fuel feeder 35 controls the supply of fuel such as gasoline supplied to the engine 31a, and is provided with a fuel tank 35a to stock the fuel, and a fuel pump 35b for supplying fuel stocked in the fuel tank 35a to the engine 31a.

The operation of the fuel pump 35b is restricted by the fuel control signal SG28. The fuel pump 35b supplies fuel such as gasoline used for the engine 31a, and it is decided whether fuel is supplied or not and the quantity of fuel is controlled in accordance with the fuel control signal SG28.

Figure 5:
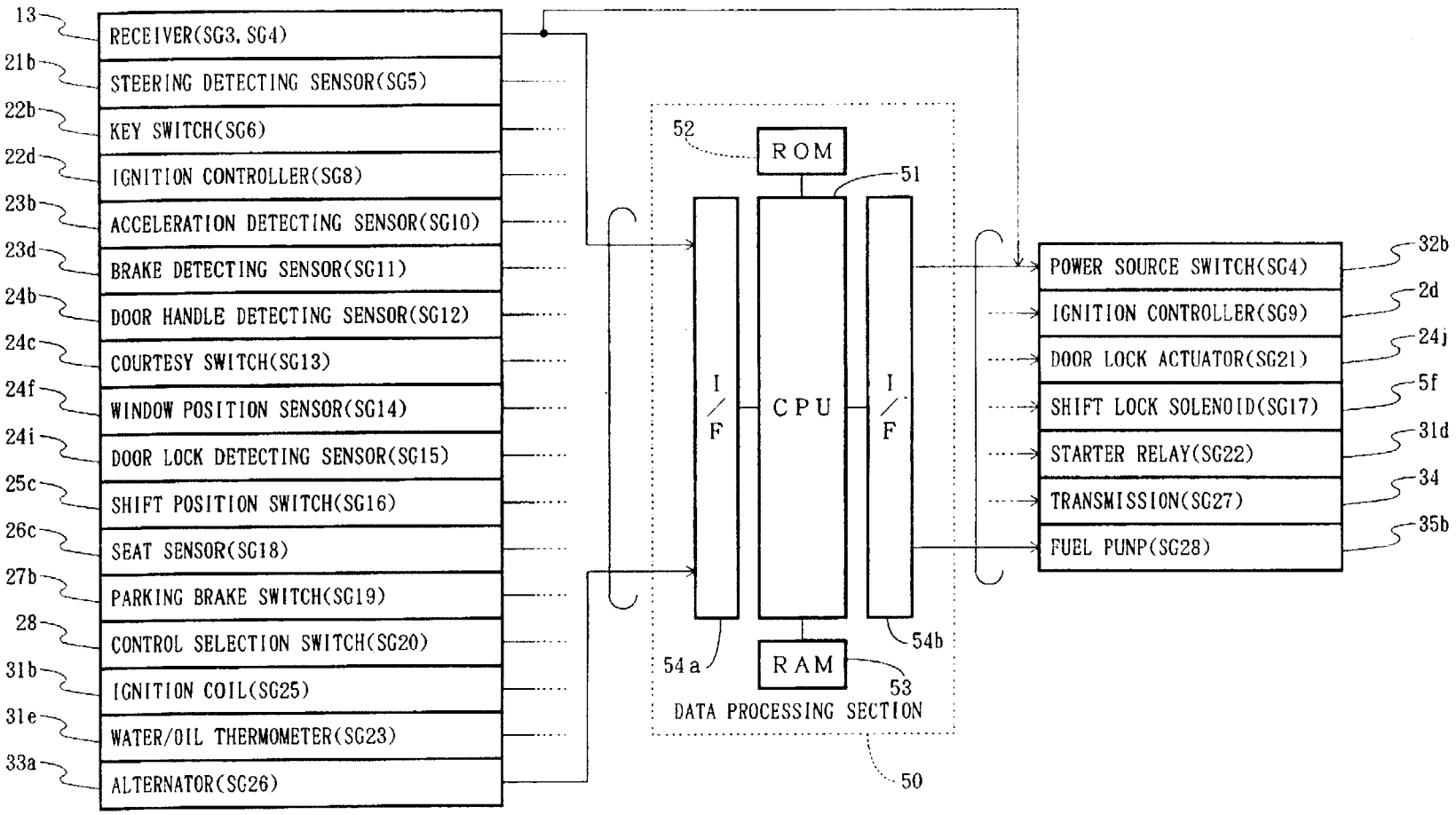
FIG. 5 is a block diagram showing the configuration of electrical elements in the vehicle according to the embodiment of the present invention.

As described above, signal and information transmitted from or transmitted to the mechanisms pass through the data processing section. That is, as illustrated in FIG. 5, a block diagram, the data processing section 50 comprises: a CPU 51; a ROM 52 in which operation program of the CPU 51 are stored; a RAM 53 in which information at the prosecution of the processing of the CPU 51 is temporary stored; an input side interface 54a through which signal or information from outer mechanisms in the vehicle is inputted to the CPU 51; and an output side interface 54b through which signal or information from the CPU 51 in inputted to the outer mechanisms.

As illustrated in the figure, to the input side interface 54a is connected the receiver 13 (code signal SG3), the steering detecting sensor 21b (steering operation signal SG5), the key switch 22b (key detecting signal SG6), the ignition controller 22d (ignition information signal SG8), the acceleration detecting sensor 23b (acceleration detecting signal SG10), the brake detecting sensor 23d (brake detecting signal SG11), the door handle detecting sensor 24b (door handle operation signal SG12), the courtesy switch 24c (door position signal SG13), the window position sensor 24f (window position signal SG14), the door lock detecting sensor 24i (door lock detecting signal SG15), the shift positioning switch 25c (shift position information SG16), the seat sensor 26c (seat detecting signal SG18), the parking brake switch 27b (parking brake operation signal SG19), the command selection switch 28 (selection signal SG20), the ignition coil 31b (rotation detecting signal SG25), the water/oil thermometer 31e (water/oil temperature information SG23), and the alternator 33a (voltage signal SG26). Signal or information transmitted from each mechanism is inputted to the input side interface 54a.

On the other hand, to the output side interface 54b is connected the power source switch 32b (ignition control signal SG4), the ignition controller 22d (compulsory OFF signal SG9), the door lock actuator 24j (door lock control signal SG21), the shift lock solenoid 25f (shift lock control signal SG17), the starter relay 31d (starter signal SG22), the transmission 34 (shift information SG27), and the fuel pump 35b (fuel control signal SG28). The output side interface 54b outputs required signal or information to each mechanism.

Next, the operation of this embodiment will be explained with reference to flowcharts in FIG. 6 to 10.

Figure 6:
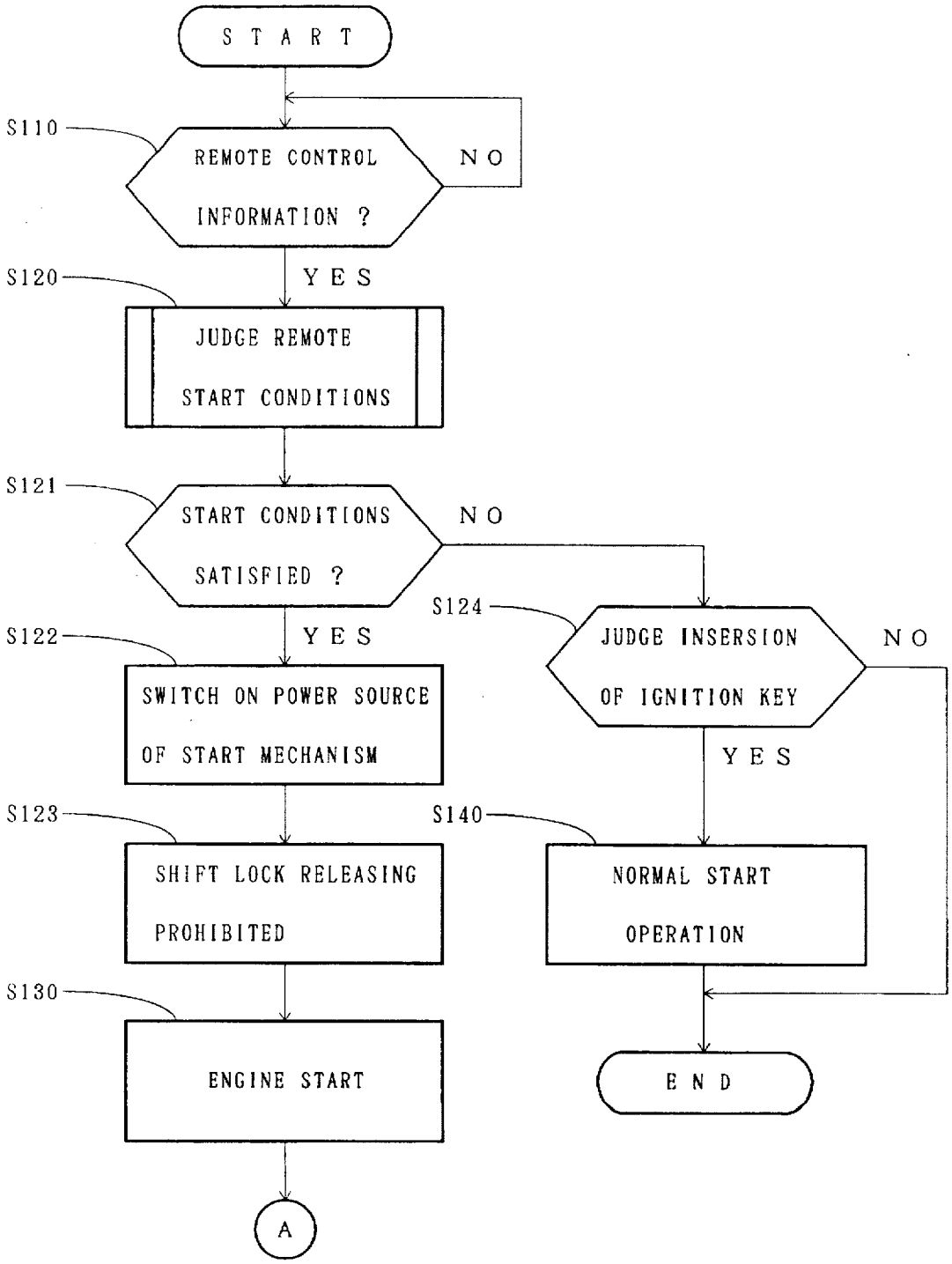
FIG. 6 is a flowchart for describing main operation of the vehicle according to the embodiment of the present invention.

In this embodiment, remote control information is firstly obtained at S110 in the flowchart in FIG. 6. The acquisition of the remote control information is carried out based on the transmission and reception of electromagnetic wave described in FIG. 2.

More particularly, at S110, operation by an operator (such as a driver) allows the antenna 11 attached to the main body 10 to receive electromagnetic wave (electromagnetic wave SG1) transmitted from the ignition key 40. Electromagnetic wave corresponding electromagnetic wave SG1 is extracted from the electromagnetic wave received by the antenna 11 through the distributor 12. In the receiver 13, the code signal SG3 is generated from the electromagnetic wave of electromagnetic wave SG1. Then, upon finishing the processing at S110, the process advances to S120.

At S120, remote start condition judging process is executed. The remote start condition judging process at S120 is a process of judging the starting condition at the start of the engine, and more particularly, this process is carried out in accordance with the flowchart shown in FIG. 8. The remote start condition judging process will hereinafter be described with reference to FIG. 8.

In this remote start condition judging process, firstly, at S310, based on the code signal SG3 from the receiver 13, whether or not this signal SG3 is the signal to start the engine is judged. In this embodiment, for simple explanation, the code signal SG3 has two kinds of codes such as a code for indicating engine start and that for releasing door lock.

Therefore, at S310, the data processing section 50 (CPU 51) recognizes the content of the operation by the operator from the code signal SG3 which is inputted through the input side interface 54*a* and selects the process in accordance with the content of the operation. When the content of the operation shows engine start, the process advances to S311, and when the content is door lock releasing to S390.

At S390, door releasing is carried out. In this door releasing operation, door position signal SG13 is transmitted from the data processing section 50 to the door lock switch 24*g* to activate the door lock switch 24*g* and energize for door lock releasing.

After the door lock releasing motion, at S390, a series of processes are completed.

At S311, the power sources of judged mechanisms are switched ON. At S311, the ignition control signal SG4 from the receiver 13 (see FIG. 2) is inputted to the power source switch 32*b* (see FIG. 4), and the electrical energy accumulated in the battery 32*a* is supplied to a related mechanism in the vehicle of which conditions are judged, which allows the mechanism to be operable.

Then, after S311, the process advances to S320 to judge whether the door are opened or not.

At S320, opening or closing of the door is judged. The judgment of the door opening/closing at S320 is performed based on the door handle operation signal SG12 from the door handle detecting sensor 24*b*. When no door handle operation signal SG12 is obtained, the door is judged to be closed, on the other hand, the output signal SG12 is presented it is judged to be opened.

If the door is opened, the process advances to S380 to judge the conditions are not satisfied. If the door is closed, the process advances to S330.

At S330, whether the door is locked or not is judged. The door lock judgment is carried out based on the door lock detecting signal SG15 outputted from the door lock detecting sensor 24*i* (see FIG. 3). At S330, almost the same judgment as at S320 is performed. If the door lock detecting signal SG15 is outputted, the door is judged to be locked. If no output of door lock detecting signal SG15 is obtained, it is judged to be unlocked.

Then, when the door is in locked state, the process advances to S340. When the door is in unlocked state, the process advances to S380 to judge the conditions are not satisfied.

At S340, shift position is judged. The shift position judgment is carried out based on the shift position information SG16 outputted from the shift positioning switch 25*c* (see FIG. 3). If the shift position information SG16 indicates "P" position, that is, the information indicates parking position, the process advances to S350. If the information indicates a position other than "P", the process advances to S380 to judge the conditions are not satisfied.

At S350, whether a parking brake works or not is judged. The parking brake judgment is carried out based on the parking brake operation signal SG19 outputted from the parking brake switch 27*b* (see FIG. 3). When the parking brake lever 27*a* is operated to output a signal showing ON state as the parking brake operation signal SG19 from the parking brake switch 27*b*, the parking brake lever 27*a* is judged to be operated, and the process advances to S360. If the parking brake operation signal SG19 from the parking brake switch 27*b* indicates OFF state, the parking brake lever 27*a* is judged to be unoperated, and the process advances to S380 to judge the conditions are not satisfied.

At S360, whether the seat is occupied or not is judged. The seat occupation judgment is carried out based on the seat detecting signal SG18 outputted from the seat sensor 26*c* (see FIG. 3) which is arranged in the seat face portion 26*b* of the seat 26. As stated above, the seat sensor 26*c* is a so-called a pressure-sensitive sensor and outputs the seat detecting signal SG18 when a predetermined pressure is applied.

Therefore, at S360, when the seat detecting signal SG18 is outputted, the seat is judged to be "occupied" to allow the process to advance to S380, where the conditions are judged to be satisfied. Unless the seat detecting signal SG18 is outputted, the process advances to S370 to judge the conditions for remote start to be satisfied.

Then, at S370 and S380, whether the conditions are satisfied or not is judged, and remote start condition acquisition process is completed.

In other words, in this remote start condition acquisition process, if all conditions such as: the door being closed (S320); the door being locked (S330); the shift position being at "P" position (S340); the parking brake being operated (S350); and nobody being seated (S360) are satisfied, the remote start condition is judged to be satisfied (S370). On the other hand, if any one of them is not satisfied, the remote start condition judged to be unsatisfied (S380).

In summary, in this remote start condition acquisition process, conditions suitable for the remote start operation such as: the door being closed and locked; the shift position being at parking position; the parking brake being operated; and nobody being seated are confirmed, and if all conditions are satisfied, it is judged that the remote start is possible.

The items of the conditions and the order thereof are not always limited as described above. For instance, the motion to confirm the opening or closing the door (S320) may be omitted since whether the door is locked or unlocked is checked at S330, and the motion to confirm whether the seat is occupied or not (S360) may firstly be checked.

Upon the completion of the remote start condition acquisition process, the process advances to S121 shown in the flowchart in FIG. 6.

At S121, based on the result of judgment at S120, whether the remote start conditions are satisfied or not, in other words, whether or not the vehicle is in a state suitable for remote start operation is judged. Then, if the conditions are satisfied, the process advances to S122, otherwise the process advances to S124.

At S122, the power source relating to mechanisms for starting is switched ON. That is, at S122, the ignition control signal SG4 from the data processing section 50 is inputted to the power source switch 32*b* and electrical energy accumulated in the battery 32*a* is supplied to the mechanisms which work at engine start such as the starter relay 31*d*, ignition controller 22*d*, so that those mechanism are in operable states.

At following step S123, a process for prohibiting the release of shift lock is carried out. That is, at S123, at the engine start, the release of the shift lock is prohibited in advance. After S123, the process advances to S130.

At S130, in accordance with the satisfaction of the remote start conditions, the engine starts. In detail, at S130, following motions are executed. The data processing section 50 outputs starter signal SG22 to the starter relay 31*d*, and the starter relay 31*d* outputs start command to the starter 31*c*. Then, the starter 31*c* rotates a crank mechanism of the engine 31*a* to start it.

Figure 7:
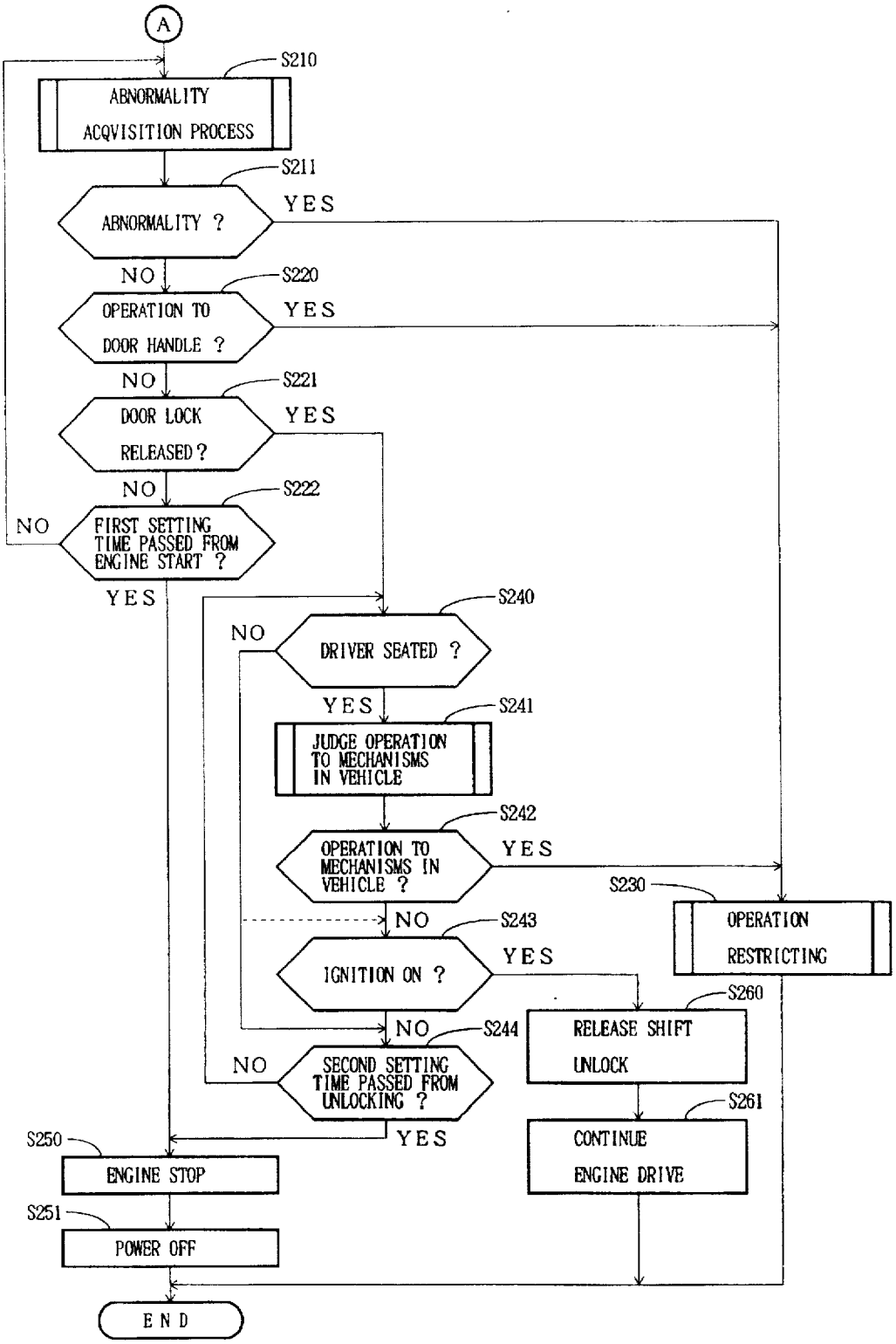
FIG. 7 is a flowchart for describing main operation of the vehicle according to the embodiment of the present invention.
Figure 8:
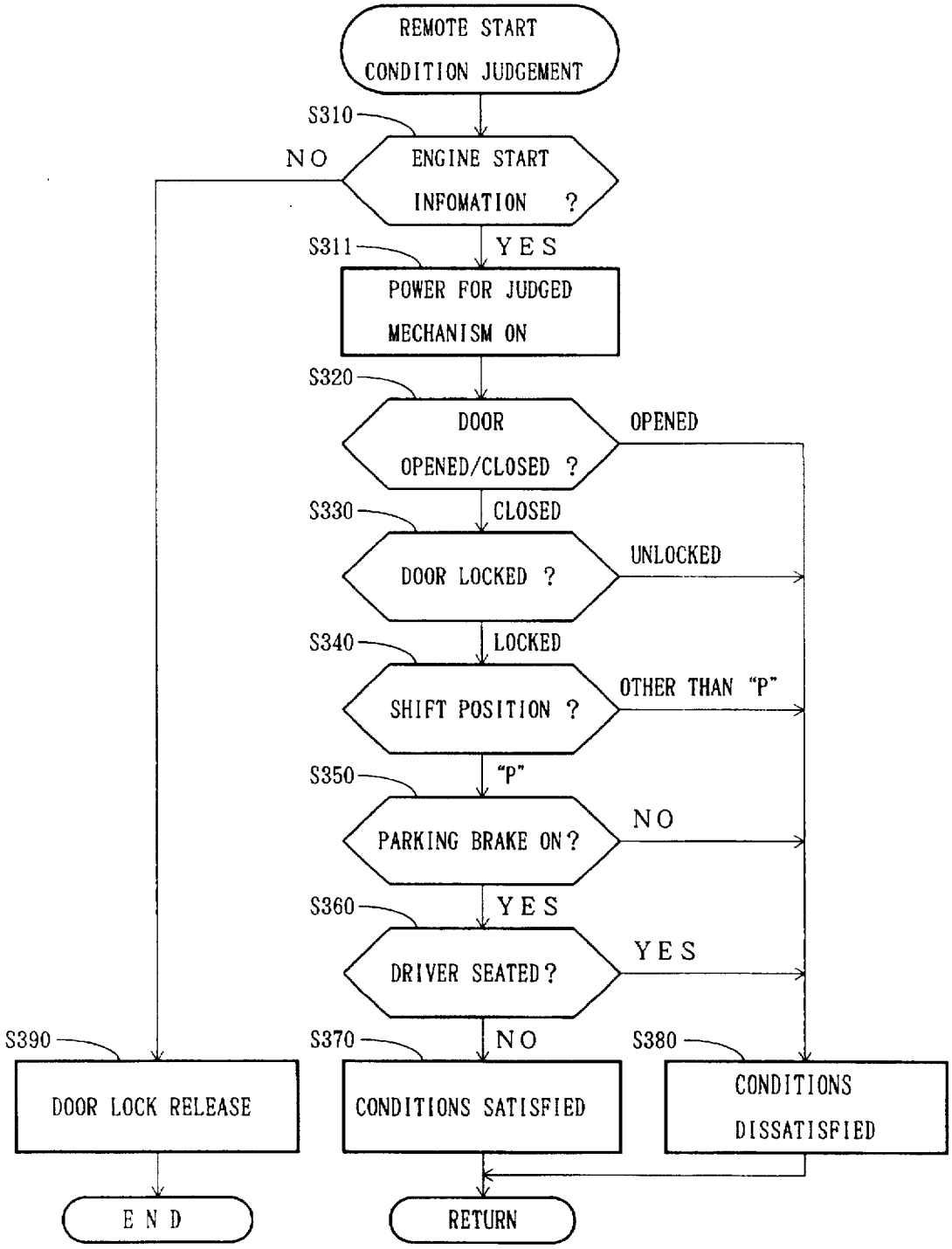
FIG. 8 is a flowchart for describing remote control information acquisition process in the vehicle according to the embodiment of the present invention.
Figure 9:
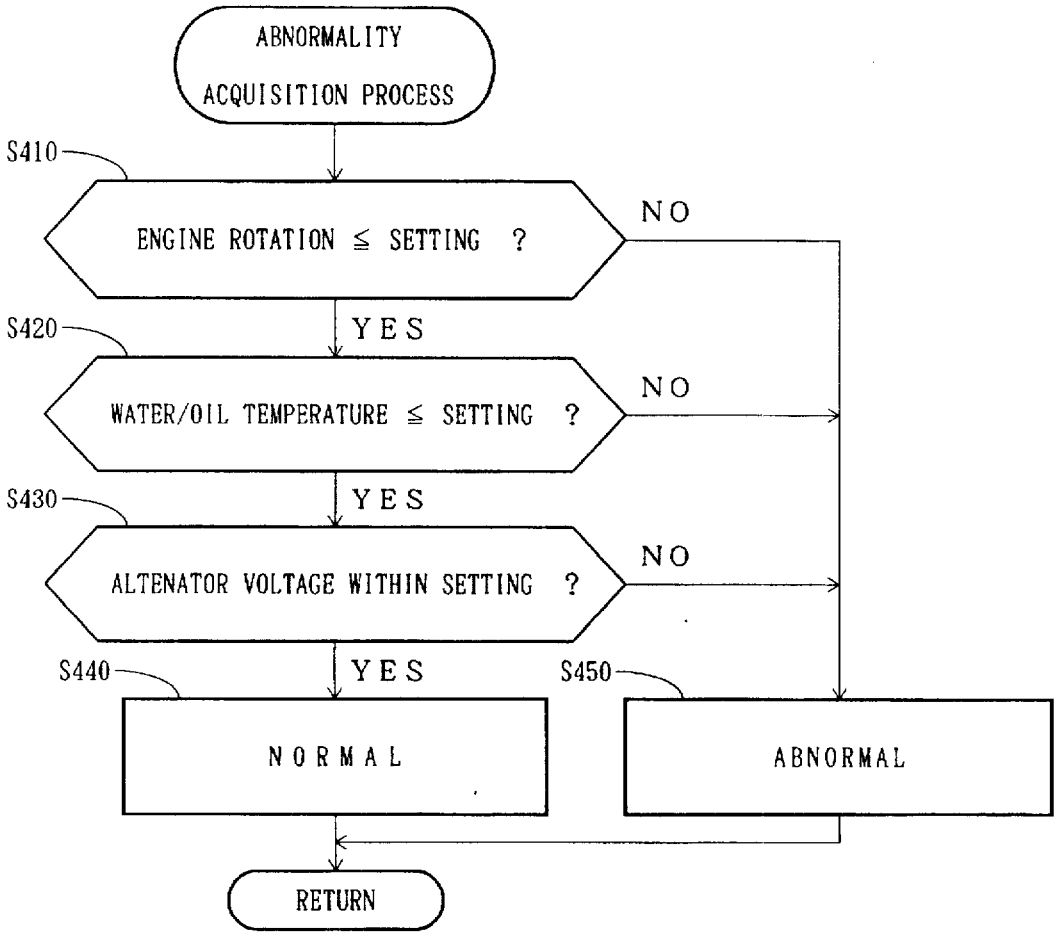
FIG. 9 is a flowchart for describing abnormality acquisition process in the vehicle according to the embodiment of the present invention.
Figure 10:
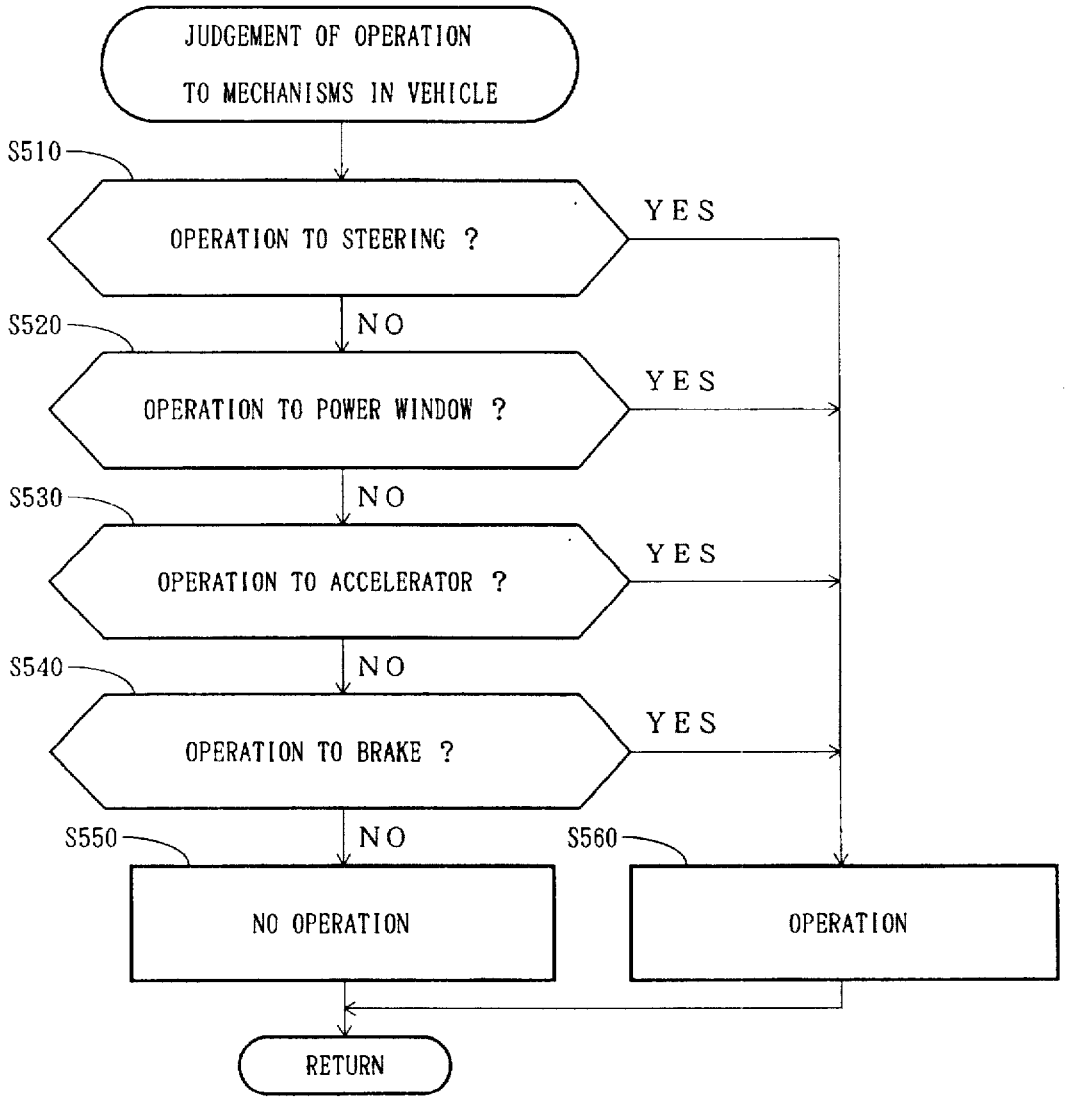
FIG. 10 is a flowchart for describing operation judgment process for mechanisms in the vehicle according to the embodiment of the present invention.

When the engine starts at S130, the process advances to S210 in the flowchart shown in FIG. 7.

On the contrary, if the conditions for start are not satisfied at S121, the process advances to S124 to detect the insertion of the ignition key 40.

The process of detecting the insertion of the ignition key 40 at S124 is performed based on key detecting signal SG6 from the key switch 22*b*, and if key detecting signal SG6 is outputted it is judged that the ignition key 40 is inserted, so that the process advances to S140.

Unless key detecting signal SG6 is outputted, a series of processes are finished as it is. That is, the case that the key detection signal is not outputted at S124 means that the vehicle have not yet been in a state suitable for remote operation and electromagnetic wave SG1 for engine start is received, so that the engine does not start and the process is finished without starting the engine.

At S140, in accordance with the insertion of the ignition key 40, it is judged as ordinary start operation and the vehicle may be operable through ordinary starting operation, that is, through the operation of the ignition key 40. Therefore, at S140, if key position information SG7 is a signal indicating OFF state, the power source of the vehicle is forced to be switched OFF, and if the key position information SG7 shows ON state, the power source of the vehicle is maintained to be in ON state. After execution of process at S140, the process is completed.

Next, with reference to the flowchart in FIG. 7, the process which should be taken after the engine starts through remote control will be described.

At S210, abnormality acquisition process on the vehicle is executed. The abnormality acquisition process at S210 is particularly carried out in accordance with the flowchart shown in FIG. 9. The abnormality acquisition process will be described below with reference to the flowchart in FIG. 9.

In the abnormality acquisition process, firstly at S410, it is judged whether the numbers of rotations of the engine are within a prescribed range or not. The numbers of rotations of engine is judged, for example, based on rotation detecting signal SG25 from the primary terminal (minus side) of the ignition coil 31*b*, and the data processing section 50 obtains the numbers of rotations of the engine through the detection of frequency of rotation detecting signal SG25.

Then, at S410, it is judged to be normal if the numbers of rotation of the engine is within a prescribed range, for instance, 2,500 rpm or below, and it is judged to be abnormal if the numbers exceed the prescribed value. Then, within the prescribed value, the process advances to the following step S420. On the contrary, if the numbers exceed the prescribed value, the process advances to S450 to judge the vehicle is in an abnormal state.

At S420, the temperatures of water and oil are checked. That is, at S420, the abnormal overheating of the engine 31*a* is detected through the temperatures of cooling water and engine oil.

Then, at S420, when both temperatures of water and oil are below a predetermined value (normal state), the process advances to S430. If any one of them exceeds the predetermined value (abnormal state), the process advances to S450 to judge the vehicle is in abnormal condition.

At S430, whether voltage (alternator voltage) generated by the alternator 33*a* is within a prescribed range or not is judged based on voltage signal SG26 from an L terminal of the alternator. If the alternator voltage is within the prescribed range (normal state), the process advances to S440, and the vehicle is judged to be in normal state. If the voltage exceeds the prescribed value (abnormal state), the process advances to S450, and the vehicle is judged to be in abnormal state.

Then, at S440 and S450, abnormality in the vehicle is judged and abnormality acquisition process is completed.

In other words, in the abnormality acquisition process described above, if all conditions such as: the numbers of rotation of the engine being lower than a prescribed value (S410); the temperatures of water and oil being below a prescribed degree (S420); the alternator voltage being within a prescribed range (S430); are satisfied, the vehicle is judged to be in normal state (S440). If any one of them is not satisfied, the vehicle is judged to be in abnormal state (S450).

In summary, in the abnormality information acquisition process, factors indicating the abnormality of engine such as the numbers of rotation of an engine, the temperature of cooling water, the temperature of engine oil, and the voltage of battery are referred, and if any factor is judged to be abnormal, the vehicle is judged to be in abnormal state.

Then, when the above-mentioned abnormality acquisition process is finished, the process advances to S211 in FIG. 7.

At S211, in accordance with the abnormality information regarding the vehicle which is obtained in the abnormality acquisition process at S210, whether the vehicle is in abnormal state or not is judged.

At S211, if an abnormality is detected, the process advances to S230 to execute the operation restricting process for the vehicle. If no abnormality is detected, the process advances to S220. Next, processes after S220 will be explained.

At S220, whether the door handle 24*a* is operated or not is judged based on door handle operation signal SG12 from the door handle detecting sensor 24*b* attached to the door handle 24*a*.

In other words, at S220, if door handle operation signal SG12 from the door handle detecting sensor 24*b* is outputted, the door handle 24*a* is judged to be operated to allow the process to advance to S230 of operation restricting process. If no door handle operation signal SG12 is outputted the door handle 24*a* is judged not to be operated to cause the process to advance to S221.

At S221, whether the door is unlocked or not is judged. The judgment of the unlocking of the door is carried out based on door lock detecting signal SG15 from the door lock detecting sensor 24*i*. Then, at S221, if door lock detecting signal SG15 is not outputted, it is judged that unlocking operation is executed to allow the process to advance to S240. On the contrary, if door lock detecting signal SG15 is outputted, it is judged that unlocking operation is not executed to allow the process to advance to S222.

In summary, at S221, whether or not the door is unlocked by prescribed unlocking means such as the ignition key 40 or remote controller is judged. If the door is unlocked by the prescribed unlocking means, the process advances to S240. On the contrary, the door is unlocked by false unlocking means or is not unlocked, the process advances to S222.

When the door is unlocked by false unlocking means at S221, for example, when the door lock lever in the vehicle is operated to unlock the door although nobody is in the vehicle, alarm may be sounded and simultaneously following processes may not be carried out.

At S222, whether or not the first prescribed period of time has passed since engine start is judged. Then, at S222, if the first prescribed period of time has not yet passed, it is judged to be "N" and the process advances to S210. If the first prescribed period of time has passed, it is judged to be "Y" and the process advances to S250. The first prescribed period of time at S222 is given as warming-up period of time for engine and is set to be approximately several minutes.

At S250, the engine stops. That is, at S250, compulsory OFF signal SG9 is transmitted to the ignition controller 22*d*, which outputs compulsory OFF signal SG9 to the ignition controller 22*d*. This causes the ignition controller 22*d* to output ignition OFF signal, so that the ignition by the ignition coil 31*b* is ceased to stop the engine.

Then, at S251, ignition control signal SG4 for switching OFF the power source switch 32*b* is outputted, which causes power to each mechanism to be cut.

Next, the case that the door lock is released at S221 will be explained. In this case, the process advances to S240 as stated above.

At S240, whether a driver is seated or not is judged. This judgment is carried out based on seat detecting signal SG18 from the seat sensor 26*c* of the seat 26. That is, at S240, whether a driver seated (on seat 26) or not is judged based on the condition of seat detecting signal SG18. Then, if it is judged that a driver is seated at S240, the process advances to the following step S241. If it is judged that a driver is not seated, the process advances to S243.

At S241, operation judgment processing for operating mechanisms in the vehicle is carried out. The operation judgment process at S241 is actually performed in accordance with the flowchart shown in FIG. 10.

In the operation judgment process for operating mechanisms in the vehicle, whether steering is operated or not is judged at S510. The judgment for steering is carried out based on steering operation signal SG5 outputted by the steering detecting sensor 21*b* attached to the steering wheel 21*a*. Then, if steering operation signal SG5 is a signal indicating that the steering is operated, the process advances to S560 to judge that the operation is executed. If steering operation signal SG5 is a signal showing no operation is executed, the process advances to S520.

At S520, whether the power window mechanism is operated or not is judged. The operation judgment at S520 is carried out based on a window position signal SG14 from the window position sensor 24*f*. If the window position signal SG14 is outputted, the process advances to S560 to judge the operation is executed. If the signal is not outputted, the process advances to S530.

At step 530, whether the acceleration pedal 23*a* is operated or not is judged. The judgment at S530 is carried out based on acceleration detecting signal SG10 from the acceleration detecting sensor 23*b*. If acceleration detecting signal SG10 is outputted, the process advances to S560 to judge that the acceleration pedal 23*a* is operated. If the signal is not outputted, the process advances to S540.

At S540, whether the brake pedal 23*c* is operated or not is judged. The judgment at S540 is carried out based on brake detecting signal SG11 from acceleration detecting sensor 23*b*. If brake detecting signal SG11 is outputted, the process advances to S560 to judge the brake pedal 23*c* is operated. If the signal is not outputted, the process advances to S550 to judge that no operation is executed to each mechanism.

As described above, after the judgment whether operations to operating mechanisms in the vehicle has been made at S550 or S560, the process advances to S242 in the flowchart in FIG. 7.

Then, at S242, with reference to information to the operating mechanisms in the vehicle which is obtained at S241, following process is selected. That is, if no operation has been made to the operating mechanisms in the vehicle (S550), the process advances to S243. In an operation has been made (S560), the process advances to S230 to perform the motion restricting process at S230.

At S243, the condition of the ignition, that is, whether or not the ignition key 40 has been inserted into the key cylinder 22*a* and the ignition has been switched ON due to the operation of the ignition key 40 is judged.

The judgment at S243 is based on the key detecting signal SG6 from the key switch 22*b* and the key position information SG7 from the ignition mechanism 22. If the key detecting signal SG6 indicates the insertion of a key and key position information SG7 indicates that the ignition is ON, it is regarded that a driver has carried out normal starting operation with the ignition key 40, which permits the process to advance to S260. On the contrary, if either key detecting signal SG6 or key position information SG7 is not in the above-mentioned state, the process advances to S244.

At S244, whether time after the lock release has passed more than the second setting value or not is judged. If the second prescribed time has not passed at S244, it is judged as "N" and the process advances to S240 to perform the above-mentioned series of processes again. On the contrary, if the second setting time has passed, it is judged as "Y" to allow the process to advance to S250. The second setting time at S244 is set as the operating period of time required for inserting the ignition key 40 by a driver, and is set approximately two to five minutes.

When the ignition controller has been judged to be ON at S243 and the process has advanced to S260, shift locking is released at S260. The shift lock arm 25*d* is driven in a direction that it is released by the shift lock solenoid 25*f* to release the shift locking (see FIG. 3). Therefore, the data processing section 50 transmits shift lock control signal SG17 to the shift lock solenoid 25*f* to release the shift locking at S260.

At the following step S261, it is decided to continue the condition that the engine is driven, and the series of processes are completed after the other mechanisms in the vehicle has been switched ON.

The processes from S210 to S261 as designated above are the processes when engine is started through remote control.

That is, it is judged whether the door lock is released in a normal way within the first setting period of time. If the door has been released in a normal way, it is judged whether the ignition controller has been switched ON through the ignition key within the second prescribed period of time.

If the ignition has been switched ON through the ignition key within the second setting time, it is judged that normal starting operation has been done, which continues the drive of the engine. On the contrary, if the door has not released within the first setting time or if the ignition controller has not switched ON within the second setting time, the process causes the engine to be stop.

Next, the process which is executed when it is judged as "abnormality exists" at S211, S220, or S242, that is, the process of operation restricting to the vehicle at S230 will be explained.

Figure 11:
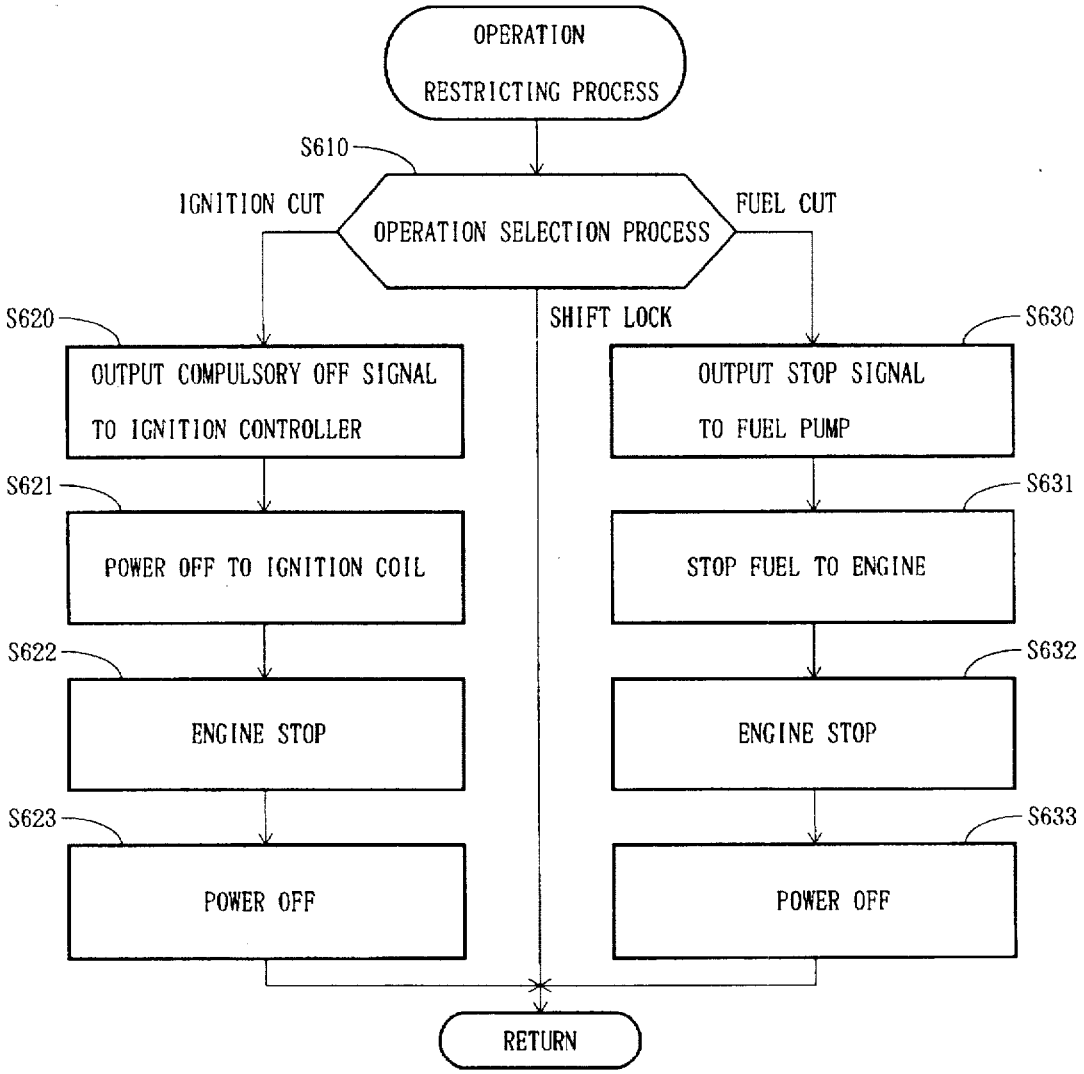
FIG. 11 is a flowchart for describing operation restricting process according to the embodiment of the present invention.

The operation restriction at S230 is actually carried out in accordance with the flowchart in FIG. 11. The operation restricting process will be explained below with reference to the flowchart in FIG. 11.

In the operation restricting process, firstly at S610, the kind of operation restricting process is selected. That is, as S610, the kind of operation restricting process is selected from engine stopping process due to no ignition, engine stopping process due to no fuel supply and shift locking process. The operation selecting process at S610 is carried out through the command selection switch 28 in the vehicle, and the data processing section 50 designates the process executed by selection signal SG20.

With respect to the selecting process, it is possible that which process is to be selected is stored in advance in a operation program in ROM 52 in the data processing section 50, and the selection is carried out based on the selection information.

Then, if the engine stopping process due to no ignition is selected, the process advances to S620, and if the engine stopping process due to no fuel supply is selected, the process advances to S630, and the shift lock is selected the present state, that is, shift lock release prohibiting state is maintained and the operation restricting process is completed.

The engine stopping process due to no ignition will be explained below.

In this process, firstly at S620, the compulsory OFF signal is outputted. In other words, at S620, the data processing section 50 outputs the compulsory OFF signal SG9 to the ignition controller 22*d*, which causes the ignition controller 22*d* to be ignition OFF.

At the following step S621, power supply to the ignition coil 31*b* is stopped, which causes the ignition of the ignition coil 31*b* at S622 to stop the engine 31*a*.

Then, at S623, the ignition control signal SG4 showing no power supply is outputted to the power source switch 32*b*, allowing the power source switch 32*b* to be switched OFF, so that no power is supplied to mechanisms in the vehicle.

Next, the engine stopping process due to no fuel supply will be explained. In this process, at S630, driving OFF signal to a fuel pump is outputted. In other words, at S630, the fuel control signal SG28 instructing the stoppage of fuel supply is outputted to the fuel pump 35*b*.

At the following step S631, fuel supply to the engine 31*a* through the fuel pump 35*b* stops based on the fuel control signal SG28 indicating stoppage of fuel supply, which causes the engine 31*a* to stop.

Then, at S632, the ignition control signal SG4 showing no power supply is outputted to the power source switch 32*b*, allowing the power source switch 32*b* to be switched OFF, so that no power is supplied to mechanisms in the vehicle.

The completion of the processes at S623 and S633 permits the operation restricting process to be ceased and simultaneously the series of processes are completed.

As clearly understood from the above explanation, the flowcharts in the embodiments and the basic configuration of the present invention is of the following relationship. The operation information outputting means 51*a* of the basic configuration of the present invention corresponds to S220 and S241 in the flowchart in FIG. 7 (S510 to S560 in the flowchart in FIG. 10); the driving mechanism stopping means 51*b* corresponds to the S620 to S623 (ignition cut means) in the flowchart in FIG. 11, and S630 to S633 (fuel supply cut means); and the power transmission stopping means 51*e* corresponds to S123 (shift lock means 51*f*) and S610 in the flowchart in FIG. 6.

As described above, with the driving mechanism controlling apparatus according to the present invention, the following effects can be obtained.

Since operation information outputting means for detecting and outputting operation to mechanisms in the vehicle is provided, when driving mechanism starts through remote control and information showing operation to the mechanism in the vehicle from the operation information outputting means in a period of time from the start of the driving mechanism to start operation to starting mechanism in the vehicle, the driving mechanism in the vehicle stops, which prevents the vacant vehicle from being stolen.

The driving mechanism stopping means is an ignition cut means or fuel supply cut means for an engine as the driving mechanism. Therefore, when abnormality in the vehicle is detected, the engine stops, so that the vacant vehicle is securely prevented from being stolen.

Since operation information outputting means for detecting and outputting operation to mechanisms in the vehicle is provided, when driving mechanism starts through remote control and information showing operation to the mechanism in the vehicle from the operation information outputting means in a period of time from the start of the driving mechanism to start operation to starting mechanism in the vehicle, the power transmission means stops, which prevents the vehicle from advancing while the driving condition of the driving mechanism being maintained. Therefore, the vacant vehicle is prevented from being stolen.

The power transmitting mechanism is a shifting mechanism positioned between the driving mechanism and the wheels, and the power transmission stopping means includes shift lock means for fixing a shift position of the shifting mechanism to "parking position", so that the power transmission of the driving mechanism is easily interrupted.

During the remote start operation, operation to the mechanism in the vehicle is scanned to judge false operation other than the release of the remote start operation abnormal, so that detection accuracy of abnormality in the vacant vehicle or robbery can be improved.

Operation selecting means for selecting which one is operated between the driving mechanism stopping means and the power transmission stopping means is provided, so that a driver can select desired control means in consideration of the use.

What is claimed is:

1. A driving mechanism controlling apparatus for vehicle comprising:

remote start means for starting a driving mechanism in a vehicle from outside through a command signal from a transmitter;

remote start releasing means for releasing a remove drive state of said driving mechanism and for converting said driving mechanism to an ordinary driving state;

seat sensing means for sensing a presence of a person in a seat of the vehicle;

operation information outputting means for detecting a presence of an operation of mechanisms in the vehicle and for outputting operation information; and driving mechanism stopping means for stopping said driving mechanism when the driving mechanism is in the remote drive state, the presence of a person in the seat is sensed by said sensing means and the operation signal from the operation information outputting means is detected.

2. The driving mechanism controlling apparatus for vehicle as claimed in claim 1, wherein said driving mechanism includes an engine driven through an ignition device, and said driving mechanism stopping means includes ignition cut means for stopping said ignition device.

3. The driving mechanism controlling apparatus for vehicle as claimed in claim 1, wherein said driving mechanism includes an engine driven through fuel supplied from a fuel supplier, and said driving mechanism stopping means includes fuel supply cut means for stopping said fuel supplier.

4. The driving mechanism controlling apparatus for vehicle as claimed in claim 1, wherein said operation information outputting means outputs operation information based on operation signal from at least one means of door scanning means for scanning one of locking/unlocking and opening/closing a door, shift position scanning means situated between the driving mechanism and wheels to scan a shift position, power window scanning means for scanning operation of power window mechanism which controls opening/closing a window of the door, parking brake scanning means, foot brake scanning means, and accelerator scanning means.

5. A driving mechanism controlling apparatus for vehicle comprising:

remote start means for starting a driving mechanism in a vehicle from outside through a command signal from a transmitter;

remote start releasing means for releasing a remote drive state of said driving mechanism and for converting said state of the driving mechanism to an ordinary driving state;

power transmitting mechanism for transmitting power from the driving mechanism to wheels;

seat sensing means for sensing a presence of a person in a seat of the vehicle;

operation information outputting means for detecting a presence of an operation of mechanisms in the vehicle and for outputting operation information; and power transmission stopping means for stopping said power transmitting mechanism when the driving mechanism is in the remote drive state, the presence of a person in the seat is sensed by said sensing means and the operation signal from the operation information outputting means is detected.

6. The driving mechanism controlling apparatus for vehicle as claimed in claim 5 wherein said driving mechanism includes an engine driven through an ignition device.

7. The driving mechanism controlling apparatus for vehicle as claimed in claim 5, wherein said driving mechanism includes an engine driven through fuel supplied from a fuel supplier.

8. The driving mechanism controlling apparatus for vehicle as claimed in claim 5, wherein said power transmitting mechanism includes a shifting mechanism positioned between said driving mechanism and said wheels, and said power transmission stopping means includes shift lock means for fixing a shift position of said shifting mechanism to parking position.

9. The driving mechanism controlling apparatus for vehicle as claimed in claim 5, wherein said operation information outputting means outputs operation information based on operation signal from at least one means of door scanning means for scanning one of locking/unlocking and opening/closing a door, shift position scanning means situated between the driving mechanism and wheels to scan a shift position, power window scanning means for scanning operation of power window mechanism which controls opening/closing a window of the door, parking brake scanning means, foot brake scanning means, and accelerator scanning means.

10. A driving mechanism controlling apparatus for vehicle comprising:

remote start means for starting a driving mechanism in a vehicle from outside through a command signal from a transmitter;

remote start releasing means for releasing a remove drive state of said driving mechanism and for converting said state of the driving mechanism to an ordinary driving state;

operation information outputting means for detecting a presence of an operation of mechanisms in the vehicle and for outputting operation information;

power transmitting mechanism for transmitting power from the driving mechanism to wheels;

power transmission stopping means for stopping said power transmitting mechanism when the driving mechanism is in the remote drive state and the operation signal from the operation information outputting means is detected;

driving mechanism stopping means for stopping said driving mechanism when the driving mechanism is in the remote drive state and the operation signal from the operation information outputting means is detected; and control selection means for transmitting selection information regarding selection of said driving mechanism stopping means or said power transmission stopping means to the operation information outputting means;

wherein said operation information outputting means outputs said operation information to said power transmission stopping means or said driving mechanism stopping means in response to said selection information transmitted from said control selection means.

11. The driving mechanism controlling apparatus for vehicle as claimed in claim 10, wherein said driving mechanism includes an engine driven through an ignition device, and said driving mechanism stopping means includes ignition cut means for stopping said ignition device.

12. The driving mechanism controlling apparatus for vehicle as claimed in claim 10, wherein said driving mechanism includes an engine driven through fuel supplied from a fuel supplier, and said driving mechanism stopping means includes fuel supply cut means for stopping said fuel supplier.

13. The driving mechanism controlling apparatus for vehicle as claimed in claim 10, wherein said power transmitting mechanism includes a shifting mechanism positioned between said driving mechanism and said wheels, and said power transmission stopping means includes shift lock means for fixing a shift position of said shifting mechanism to parking position.

14. The driving mechanism controlling apparatus for vehicle as claimed in claim 10, wherein said operation information outputting means outputs operation information based on operation signal from at least one means of door scanning means for scanning one of locking/unlocking and opening/closing a door, shift position scanning means situated between the driving mechanism and wheels to scan a shift position, power window scanning means for scanning operation of power window mechanism which controls opening/closing a window of the door, parking brake scanning means, foot brake scanning means, and accelerator scanning means.

15. The driving mechanism controlling apparatus of claim 10, further comprising:

seat sensing means for sensing a presence of a person in a seat of the vehicle; wherein said power transmission stopping means and said driving mechanism stopping means are responsive to said seat sensing means for stopping said power transmitting mechanism and said driving mechanism, respectively, when the driving mechanism is in a remote state, the presence of a person in the seat is sensed by said sensing means and the operation signal from the operation information outputting means is detected.

* * * * *